US005567072A

United States Patent [19]

Dunleavy et al.

[11] Patent Number: 5,567,072

[45] Date of Patent: Oct. 22, 1996

[54] MASCARA APPLICATOR HAVING SLOTTED BRISTLES

[75] Inventors: Thomas J. Dunleavy, North Salem; Walter K. Kemmerer, Cortlandt Manor, both of N.Y.

[73] Assignee: Risdon Corporation, Naugatuck, Conn.

[21] Appl. No.: 477,919

[22] Filed: Jun. 7, 1995

[51] Int. Cl.[6] ..... A63B 11/00; A45D 40/26

[52] U.S. Cl. ..... 401/129; 132/218; 15/207.2

[58] Field of Search ..... 401/35, 129, 127, 401/126, 123, 119, 118; 132/216, 218, 320; 15/207.2

[56] References Cited

U.S. PATENT DOCUMENTS

| | | | |
|---|---|---|---|
| D. 331,150 | 11/1992 | Hartel . | |
| 2,317,485 | 4/1943 | Rider | 15/207.2 X |
| 2,465,396 | 3/1949 | Peterson et al. . | |
| 2,637,893 | 5/1953 | Shaw . | |
| 2,895,155 | 7/1959 | Peterson . | |
| 3,121,040 | 2/1964 | Shaw et al. | 15/207.2 X |
| 3,217,074 | 11/1965 | Gould et al. | 15/207.2 X |
| 3,344,457 | 10/1967 | Grobert . | |
| 4,279,053 | 7/1981 | Payne et al. | 15/207.2 |
| 4,307,478 | 12/1981 | Ward et al. . | |
| 4,365,642 | 12/1982 | Costa . | |
| 4,403,624 | 9/1983 | Montgomery . | |
| 4,461,312 | 7/1984 | Gueret . | |
| 4,545,393 | 10/1985 | Gueret et al. . | |
| 4,559,268 | 12/1985 | Nakashima et al. | 15/207.2 X |
| 4,561,456 | 12/1985 | Gueret . | |
| 4,565,205 | 1/1986 | Taylor . | |
| 4,660,582 | 4/1987 | Taylor . | |
| 4,722,425 | 3/1988 | Hartel et al. | 401/129 X |
| 4,733,425 | 3/1988 | Hartel et al. . | |
| 4,804,004 | 2/1989 | Taylor . | |
| 4,807,652 | 2/1989 | Bachrach | 15/207.2 X |
| 4,861,179 | 8/1989 | Schrepf et al. . | |
| 4,887,622 | 12/1989 | Gueret . | |
| 4,927,281 | 5/1990 | Gueret | 401/129 |
| 4,961,665 | 10/1990 | Fitjer . | |
| 4,974,612 | 12/1990 | Gueret . | |
| 4,993,440 | 2/1991 | Gueret . | |
| 5,002,415 | 3/1991 | Gueret . | |
| 5,063,947 | 11/1991 | Gueret . | |
| 5,064,306 | 11/1991 | Gueret . | |
| 5,096,319 | 3/1992 | Gueret . | |
| 5,161,554 | 11/1992 | Fitjer . | |
| 5,165,760 | 11/1992 | Gueret . | |
| 5,238,011 | 8/1993 | Gueret . | |
| 5,335,465 | 8/1994 | Gueret . | |
| 5,345,644 | 9/1994 | Gueret . | |

*Primary Examiner*—Robert A. Hafer
*Assistant Examiner*—D. Neal Muir
*Attorney, Agent, or Firm*—St. Onge Steward Johnston & Reens

[57] ABSTRACT

An applicator for the application of a cosmetic medium, such as mascara, is disclosed having a central core, preferably formed from a twisted metal wire, having a brush section at one end thereof. The brush section comprises a plurality of radially extending bristles gripped medially by the central core. At least some of the bristles have a substantially slotted cross-sectional configuration, most preferably, each bristle is substantially hollow and has a slot extending along at least a portion of the length of the bristle. The cross-sectional configuration of the slotted filaments is such that the gripping thereof by the core causes the slotted filaments to flare outwardly in a generally random direction and so as to be substantially uniformly distributed throughout the brush section; unlike the prior art bristles, the bristles of the present invention do not follow a substantially helical pattern when gripped by the twisted wire core. Various types of slotted filaments are disclosed including a rectangular type (having four sidewalls) and triangular type (having three sidewalls). In each type, the slot is open along at least a portion of one sidewall.

12 Claims, 1 Drawing Sheet

MASCARA APPLICATOR HAVING SLOTTED BRISTLES

FIELD OF THE INVENTION

The present invention relates to applicators used to apply cosmetics, and, more particularly, to applicators used to apply mascara to eyelashes.

BACKGROUND OF THE INVENTION

Mascara applicators having a single metallic wire which is folded in a u-shaped configuration and having nylon bristles disposed therebetween are known. Generally, the u-shaped wire is twisted to form a helical core; the twisting of the core causes the bristles, or filaments, to be arranged about the core in a substantially helical or spiral pattern. See e.g., U.S. Pat. No. 5,165,760 to Gueret; U.S. Pat. No. 4,887,622 to Gueret; and U.S. Pat. No. D331,150 to Hartel.

The twisted wire applicators of the aforementioned type may comprise, for example, bristles having any one or a combination of the following cross-sectional configurations: hollow and tubular (see e.g., U.S. Pat. No. 4,733,425 to Hartel et al.); solid and tubular (see e.g., U.S. Pat. No. 5,165,760 to Gueret); or cruciform (see e.g., U.S. Pat. No. 4,887,622 to Gueret). Conventional bristles having any of the aforementioned cross-sectional configurations, however, fail to maximize the cosmetic product carrying surface because mascara pickup is limited to the exterior surface of the bristle; thus the product pickup and product retention is not maximized. When the product pickup and retention is insufficient, the user must reintroduce the mascara applicator into the reservoir and repeatedly stroke the eyelashes to apply a desirable amount of mascara and to obtain a uniform application of it.

Further, mascara applicators wherein the bristles are arranged in a generally spiral or helical manner are sometimes undesirable because they do not maximize the surface area which can apply the mascara to the eyelashes. For example, if the core has relatively few turns, there can be wide gaps between bristles at a predetermined location and their neighbors directly above and directly below that location. These gaps, which contains no bristles, do not pick up and carry mascara, and, as such, reduce the amount of cosmetic medium which can be applied to a user's eyelashes.

U.S. Pat. No. 4,733,425 to Hartel attempts to provide an applicator having a wire core, wherein the bristles, when twisted, do not follow the helical pattern of the twisted wire core. Hartel discloses, however, only hollow tubular bristles, and bristles that are noncircular in cross-section and which have a plurality of longitudinal, radially extending flange or rib portions, such as a "cruciform" filament. As discussed above, these bristles fail to maximize product pickup and retention.

What is desired, therefore, is a cosmetic applicator which comprises bristles which do not follow a helical or spiral pattern when gripped by a twisted wire core, which maximize the amount of cosmetic product pickup and retention and which provide a smooth and uniform application of the cosmetic medium to the eyelashes.

SUMMARY OF THE INVENTION

Accordingly, it is an object of the present invention to provide an applicator which comprises bristles, which, when bound by a twisted metal core, are arranged in an "interwoven" manner, that is, a manner wherein the bristles are not simply arranged in a substantially spiral or helical manner.

It is another object of the present invention to provide a mascara applicator which maximizes the amount of cosmetic product pickup and retention.

It is yet another object of the present invention to provide a mascara applicator wherein the mascara is not limited to the exterior surface of the bristle.

To overcome the deficiencies of the prior art and to achieve the objects and advantages listed above, a mascara applicator is disclosed which comprises a central core preferably formed from a twisted wire and having a brush section at one end thereof. The brush section comprises a plurality of regularly disposed and radially extending bristles having a cross-sectional configuration of any of the types discussed below and sufficient stiffness or rigidness such that when gripped medially (i.e., between the ends thereof) by the core, they are arranged in an "interwoven" pattern and, as such, do not strictly follow the helical pattern of the twisted wire core.

In the preferred embodiment, at least some of the bristles, and preferably all of the bristles, comprise a filament having a substantially slotted cross-sectional configuration. In other words, these bristles are hollow and have a slot extending along at least a portion of the length of the bristles, and, preferably, along the entire length of the bristles. The slot in each type of bristle is sufficiently sized to allow the passage of the cosmetic medium, such as mascara, into the slot increasing the amount of product retention. Because the slot provides for an interruption of an otherwise smooth outer bristle surface, mascara accumulates in the slot resulting in increased produce retention when compared to conventional bristles. Further, depending on various factors, including the viscosity of the mascara and the size of the slot, additional mascara may flow through the slot and into the interior of the filament, providing even more product retention.

Different "types" of generally slotted bristles are disclosed herein. In one type, the filament is generally tubular and a slot extends along at least a portion of the sidewall of the filament. In another type, the filament comprises four sidewalls positioned to form a generally rectangularly-shaped filament and a slot extends along about 50% to about 75% of one sidewall. In still another type of bristle, the bristle comprises three sidewalls positioned to form a generally triangularly-shaped filament and a slot extends along about 50% to about 75% of one sidewall.

It should be understood that, in all the types of bristles disclosed herein, the bristles are constructed of sufficient rigidness such that when crimped by the metal wire core, the bristles flair outwardly in a generally random fashion and do not follow the helical pattern of the twisted wire core.

It should also be understood that, in all the types of bristles disclosed herein, the slot extends, preferably, along the entire length of the filament. The slot can, however, extend only partially along the length of the filament, if desired.

The cross-sectional configuration and rigidness of each of the types of slotted filaments is such that the gripping thereof causes the filaments to flare outwardly in a substantially random direction so as to be substantially uniformly distributed throughout the brush section. Thus, the slotted bristles, when crimped by the twisted wire core, generally flare outwardly in a substantially V-shaped manner. The flaring action by the bristles constructed in accordance with the present invention is substantially random in the radial direction and results in a substantially uniform bristle tip distribution in the brush section of the applicator. This is in contrast to the characteristically helical pattern of the bristle distribution of the prior art. Advantageously, due to the slotted cross sectional configurations of the bristles and the resulting "interwoven" design, the applicator of the present application provides more product retention when compared to conventional mascara applicators.

Significantly, bristles made in accordance with the present invention allow for more product pickup and retention because the cosmetic medium is not limited to the exterior of the bristles unlike prior art bristles and rather can accumulate in the slot. Further, depending on various factors such as the size of the slot and the viscosity of the cosmetic medium, the cosmetic medium may flow through the slot and into the interior of the bristle, resulting in still further product retention.

The invention and its particular features and advantages will become more apparent from the following detailed description when considered with reference to the accompanying drawings.

DETAILED DESCRIPTION OF THE DRAWINGS

Figures 1, 2, 3, 4, 5, 6:
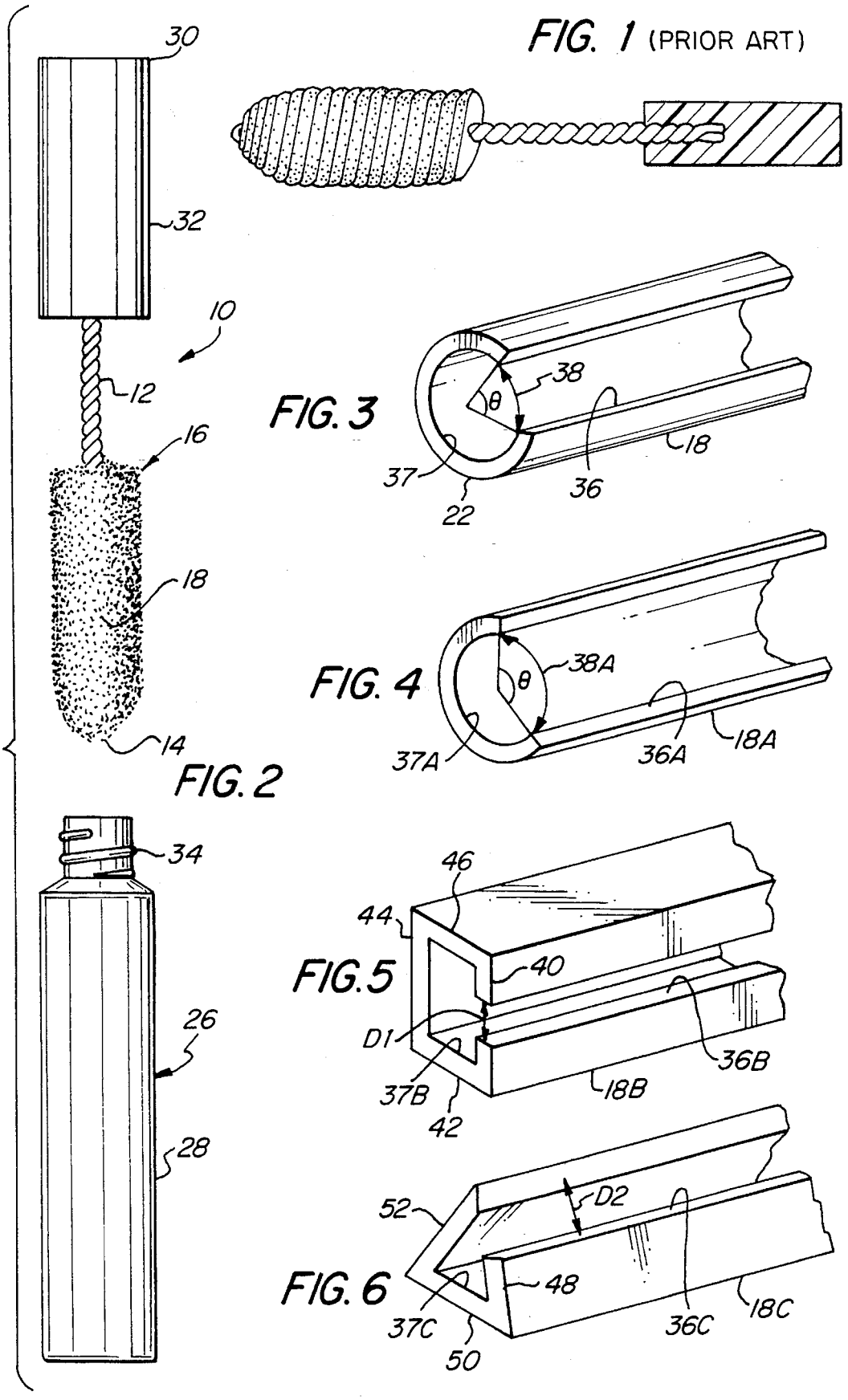
FIG. 1 (PRIOR ART)
FIG. 1 is a side view in partial cross-section of a prior art applicator, wherein the bristles, when gripped by a twisted wire core, are disposed in a generally helical or spiral manner about the core.
FIG. 2 is a side view of a mascara applicator constructed in accordance with the present invention, showing the filaments arranged in an "interwoven" fashion.
FIG. 3 is an isometric view of a single bristle (with portions broken away), which is gripped by the core of the applicator shown in FIG. 2.
FIGS. 4–6 are isometric views of additional bristles of alternate types (with portions broken away), which could be used in conjunction with or in lieu of the bristle of FIG. 3 for use in the applicator shown in FIG. 2.

Referring to the drawings in detail, a mascara applicator in accordance with the present invention is shown and generally designated by the reference numeral 10. It should be noted that for the sake of clarity all the components and parts of applicator 10 may not be shown and/or marked in all the drawings. As used in this description, the terms "up", "down", "top", "bottom", etc. refer to applicator 10 when in the orientation illustrated in FIG. 2, although it will be recognized that applicator 10 may be in any orientation when in use.

As best shown in FIG. 2, applicator 10 comprises a central core 12 having a first end 14 and brush section 16 extending from first end 14 along central core 12. A plurality of regularly disposed and radially extending bristles, such as 18 (best shown, for example, in FIG. 3) comprise brush section 16. Each bristle 18, for example, has two free ends, one end identified as 22 (FIG. 3).

Referring to FIG. 2, applicator 10 is adapted in size and shape so as to be conveniently stored in a container 26, when not in use or when necessary to pick up mascara for application to a user's eyelashes. Container 26, having housing 28, has an internal chamber or reservoir (not shown), for storing a cosmetic medium, such as mascara, as is known in the art. One suitable reservoir is shown and described in U.S. Pat. No. 4,365,642 to Costa, and entitled "Cosmetic Applicator and Associated Method", the disclosure of which is hereby incorporated by reference.

Core 12 can be made of any suitable material and by any suitable method sufficient to hold and retain bristles 18, but it is preferably made of steel, and most preferably, stainless steel.

Referring to FIG. 2, core 12 has bristles 18, for example, disposed at one end (i.e., brush section 16), while the other end 30 comprises handle 32 to facilitate the application of the mascara and which also serves as a cap for container 26 when not in use. Handle 32 has a threaded portion (not shown) designed so as to be received by complementary threaded portion 34 of container 26 to seal cap 32 to container 26 so that mascara is stored in a relatively leak-proof manner.

Referring to FIGS. 2, 3, a multiplicity of generally tubular slotted bristles, sometimes referred to as filaments, such as 18 are regularly disposed about brush section 16 of core 12. Bristles 18 can be made of any material capable of carrying and applying mascara and may be formed by any suitable method such as by the extrusion of a plastic material. Suitable materials include any type of synthetic material, including polyamide, polyesters, polyolefins and the like. Preferably bristles 18 are made of nylon, and most preferably made of 6-12 type nylon.

Bristles 18 preferably have a length of about 0.100 mils to about 0.380 mils. It should be understood, however, that bristles 18 may be any length provided they are sufficiently long to pick up and retain mascara and sufficiently long to comb the user's eyelashes.

In accordance with the present invention, at least some of the bristles 18, for example, in brush section 16 comprise a filament having a substantially slotted cross-sectional configuration. The cross-sectional configuration of each filament is such that the gripping thereof by core 12 causes it to flare radially outwardly in a substantially random direction and so as to be generally uniformly distributed throughout brush section 16.

Preferably, at least some bristles, and preferably each bristle, 18 is generally tubular and hollow, and has a slot 36 extending along at least a portion of the length of the bristle 18, and most preferably along the entire length of bristle 18. Slot 36 may be of any size and shape sufficient to allow the passage of cosmetic medium into slot 36 and, if desired, into interior 37 of filament 18. Slot 36 is measured through an angle θ 38, which is preferably about 10° to about 90°. Filaments 18 exhibit a significant capillary attraction for the cosmetic medium, and, as such, are capable of picking up and retaining more mascara than conventional mascara applicators.

Bristles 18 are attached to core 12 in a manner generally known in the art. Preferably, core 12 is folded in a generally U-shaped configuration (not shown) and the bristles, such as 18, are substantially medially disposed between the legs of the U-shaped core and the legs of core 12 are twisted. Unlike most prior art bristles (FIG. 1) in which the bristle distribution follows the helical path of the twisted wire core, the bristle distribution of the present invention is substantially random and, to a great extent, uniformly distributed throughout brush section 16, resulting in an "interwoven" pattern. See FIG. 2.

Other types of bristles 18A, 18B, 18C are shown in FIGS. 4–6, respectively. Bristle 18A, more particularly, comprises a hollow, tubular bristle having a slot 36A which is preferably wider than the slot 36 of bristle 18. Slot 36A may be of any size sufficient to allow the passage of cosmetic medium into slot 36A and, if desired, into the interior 37A of bristle 18A. Slot 36A is measured through angle θ 38A which is preferably about 90° to about 180°.

Bristle 18B, shown in FIG. 5, comprises four sidewalls 40, 42, 44, 46 positioned so as to form a generally rectangularly-shaped filament. Slot 36B extends along at least some and preferably the entire length of a side wall such as 42 and is sufficiently sized to allow the passage of cosmetic medium into slot 36B and, if desired, into the interior 37B of filament 18B. In the preferred embodiment, slot 36B is open along about 50% to about 75% of one side wall. Slot 36B, preferably, has a height D1 of about 0.0005 to about 0.0025 inches, and most preferably between about 0.001 to about 0.002 inches.

Bristle 18C, shown in FIG. 6, comprises three sidewalls 48, 50, 52 positioned to form a generally triangularly-shaped filament. Slot 36C extends along at least a portion of one sidewall such as 48, but preferably extends along the entire length of the sidewall. Slot 36C is sized sufficiently to allow the passage of cosmetic medium into slot 36C and, if desired, into the interior 37C of filament 18C. In the preferred embodiment, slot 36C is open along about 50% to about 75% of the sidewall. Preferably, it has a height D2 of about 0.0005 to about 0.0025 inches, and most preferably between about 0.001 to about 0.002 inches.

Each bristle 18, 18A, 18B, 18C disclosed herein is constructed of sufficient rigidness such that when crimped by the metal core 12 (FIG. 2), they flare outwardly in a generally random fashion and do not follow the generally helical pattern of twisted wire core 12.

It should be understood that slots 36, 36A, 36B, 36C are preferably sized to maximize the amount of cosmetic pick up and retention. It should further be understood that slots 36, 36A, 36B, 36C most preferably extend the entire length of bristle 18, 18A, 18B, 18C, respectively, but may, as desired, extend along only a portion of the bristle.

Advantageously, bristles 18, 18A, 18B, and 18C allow for more product pick up and retention than prior art bristles, because bristles 18, 18A, 18B, 18C do not limit the cosmetic medium to the exterior of the bristles. That is, the cosmetic medium may be picked up and retained inside slot 36, 36A, 36B and 36C of bristle 18, 18A, 18B, 18C, respectively. Further, depending on various factors, including the viscosity of the mascara and the size of the slot, additional cosmetic medium may flow through the slot and into the interior of the filament, providing even more product retention.

It should also be understood that an applicator of the present invention could utilize only one type of bristle 18, 18A, 18B, 18C or any combination of bristles 18, 18A, 18B, 18C.

Each of the filaments of the different types of the present invention (FIGS. 3–6) are adapted to pickup and retain more cosmetic medium than conventional bristles and to transport more cosmetic medium to the eyelashes, for example, with reduced possibilities of dripping. Further, each of the bristles 18, 18A, 18B, 18C of the present invention provide for more uniform application of the mascara to the eyelashes than conventional bristles.

It should also be understood that the invention has been described for use with mascara applicators for the sake of convenience only and is not intended to be limiting. Other articles may be made in a similar manner after reading and understanding this disclosure.

It should be understood that the foregoing is illustrative and not limiting and that obvious modifications may be made by those skilled in the art without departing from the spirit of the invention. Accordingly, reference should be made primarily to the accompanying claims, rather than the foregoing specification, to determine the scope of the invention.

What is claimed is:

1. An applicator for the application of a cosmetic medium, comprising: a central core having a brush section at one end thereof, the brush section comprising a plurality of radially extending bristles gripped by the central core, at least some of the bristles comprising a filament having a predetermined length and rigidness and comprising three sidewalls, each of the sidewalls having opposing ends, each of the sidewalls joined at the ends to form a substantially triangular shape and a slot extends substantially longitudinally and through at least a portion of one of the sidewalls between its ends, the slot being sufficiently sized to allow the passage of cosmetic medium into the slot into a substantially hollow interior, the rigidness of the filaments being such that the gripping thereof by the core causes them to flare outwardly in a generally random direction so as to be substantially uniformly distributed throughout the brush section.

2. The applicator for the application of a cosmetic medium of claim 1, the slot being open along 50–70% of one sidewall of the filament.

3. The applicator for the application of a cosmetic medium of claim 1, each bristle being substantially hollow.

4. The applicator for the application of a cosmetic medium of claim 1, the core being formed from at least one twisted wire, wherein the bristles extend radially from the twisted wire core.

5. The applicator for the application of a cosmetic medium of claim 1, the bristles being formed by the extrusion of a plastic material.

6. An applicator for the application of mascara to the eyelashes, comprising: a central core having a brush section at one end thereof, the core being formed from a twisted wire, the brush section comprising a plurality of radially extending bristles gripped medially by the central core, at least some of the bristles comprising a hollow filament having predetermined length and rigidness and four sidewalls, each of the sidewalls having opposing ends, each of the sidewalls joined at the ends to form a generally rectangular shape and a slot extends substantially longitudinally and through at least a portion of one of the sidewalls between its ends, the slot having a size sufficient to allow the passage of mascara into the slot into a substantially hollow interior, the rigidness of each filament being such that the gripping thereof causes the filaments to flare outwardly in a generally random direction so as to be substantially uniformly distributed throughout the brush section.

7. The applicator for the application of mascara to the eyelashes of claim 6, the slot being open along about 50–70% of one sidewall of the filament.

8. The applicator for the application of mascara to the eyelashes of claim 6, the bristles being formed by the extrusion of a plastic material.

9. The applicator for the application of mascara to the eyelashes of claim 6, each bristle being substantially hollow.

10. An applicator for the application of mascara to the eyelashes, comprising: a central core having a brush section at one end thereof, the brush section comprising a plurality of radially extending bristles disposed about the central core, at least some of the bristles comprising a filament having four sidewalls, each of the sidewalls having opposing ends, each of the sidewalls joined at the ends to form a generally rectangular shape having predetermined length and rigidness, each filament having a slot extends substantially longitudinally and through at least a portion of one of the sidewalls, the slot having a size sufficient to allow the passage of mascara into the slot into a substantially hollow interior, the rigidness of each filament being such that the gripping thereof causes the filaments to flare outwardly in a generally random direction so as to be substantially uniformly distributed throughout the brush section.

11. The applicator for the application of mascara to the eyelashes of claim 10, the slot being open along about 50–70% of one sidewall of the filament.

12. The applicator for the application of mascara to the eyelashes of claim 11, the core being formed from a twisted wire, the bristles being radially disposed about the twisted wire core.

* * * * *

UNITED STATES PATENT AND TRADEMARK OFFICE

CERTIFICATE OF CORRECTION

PATENT NO. : 5,567,072
DATED : October 22, 1996
INVENTOR(S) : Thomas J. Dunleavy, et. al.

It is certified that error appears in the above-indentified patent and that said Letters Patent is hereby corrected as shown below:

At Column 1, line 43, "contains" should be replaced with --contain--.

At Column 2, line 32, "produce" should be replaced with --product--.

At Column 5, lines 7 and 11, "side wall" should be replaced with --sidewall.--

At Column 5, line 53, "pickup" should be replaced with --pick up--.

Signed and Sealed this

Eighteenth Day of February, 1997

*Attest:*

Bruce Lehman

BRUCE LEHMAN

*Attesting Officer*

*Commissioner of Patents and Trademarks*